US011279593B2

(12) United States Patent
Jiang

(10) Patent No.: US 11,279,593 B2
(45) Date of Patent: Mar. 22, 2022

(54) COMPENSATION LINE STORING APPARATUS, JUMP LIFT AND THE USAGE METHOD THEREOF

(71) Applicant: Otis Elevator Company, Farmington, CT (US)

(72) Inventor: Mingming Jiang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 382 days.

(21) Appl. No.: 16/414,027

(22) Filed: May 16, 2019

(65) Prior Publication Data

US 2019/0352129 A1 Nov. 21, 2019

(30) Foreign Application Priority Data

May 17, 2018 (CN) ..... 201810473845.0

(51) Int. Cl.
*B66B 7/06* (2006.01)
*B66B 9/00* (2006.01)

(52) U.S. Cl.
CPC ..... *B66B 7/068* (2013.01); *B66B 9/00* (2013.01)

(58) Field of Classification Search
CPC .. B66B 7/068; B66B 9/00; B66B 7/10; B66B 19/02
See application file for complete search history.

(56) References Cited

U.S. PATENT DOCUMENTS 3,519,101 A * 7/1970 Sieffert ..... B66B 9/187 187/256
5,000,292 A * 3/1991 Chapelain ..... B66B 19/002 187/408
5,033,586 A * 7/1991 Richards ..... B66B 9/187 187/259
5,513,724 A * 5/1996 De Jong ..... B66B 7/06 187/264

(Continued)

FOREIGN PATENT DOCUMENTS

CN 205662195 U 10/2016
EP 1154947 B1 4/2006

(Continued)

OTHER PUBLICATIONS

European Search Report for application EP 19175248.4, dated Oct. 11, 2019, 8 pages.

*Primary Examiner* — Michael A Riegelman
(74) *Attorney, Agent, or Firm* — Cantor Colburn LLP

(57) ABSTRACT

The present invention provides a compensating wire bundle storage device, a jump lift and a usage method thereof. The compensating wire bundle storage device comprises one or more wire drum which are configured such that a compensating wire bundle is wound thereon and are fixed relative to the car of the jump lift; and a compensating wire bundle clamping device configured to releasably clamp the compensating wire bundle, wherein the compensating wire bundle clamping device is fixed under the car. The compensating wire bundle storage device and the lift of the present invention have the advantages of a simple structure, being easy to manufacture, being convenient to install, etc., and can provide a greater lifting height for lifts, thereby improving the operation efficiency.

17 Claims, 2 Drawing Sheets

(56) References Cited

U.S. PATENT DOCUMENTS

| | | | | |
|---|---|---|---|---|
| 8,141,684 | B2 * | 3/2012 | Bjorni | B66B 11/08 187/264 |
| 2010/0163347 | A1 * | 7/2010 | Van Der Meijden | B66B 19/00 187/254 |
| 2011/0113720 | A1 * | 5/2011 | Peacock | B66B 19/00 52/741.1 |
| 2012/0217101 | A1 * | 8/2012 | Peacock | B66B 11/00 187/414 |
| 2012/0291395 | A1 * | 11/2012 | Plathin | B66B 19/02 52/741.1 |
| 2014/0231179 | A1 * | 8/2014 | Alasentie | B66B 7/062 187/251 |
| 2015/0034425 | A1 * | 2/2015 | Ratia | B66B 7/06 187/249 |
| 2015/0298940 | A1 * | 10/2015 | Hense | B66B 5/042 187/254 |
| 2017/0166419 | A1 * | 6/2017 | Rasanen | B66B 19/005 |
| 2019/0322491 | A1 * | 10/2019 | Christen | B66B 19/00 |
| 2019/0352129 | A1 * | 11/2019 | Jiang | B66B 19/00 |
| 2020/0180912 | A1 * | 6/2020 | Li | B66B 19/00 |

FOREIGN PATENT DOCUMENTS

| | | | |
|---|---|---|---|
| EP | 2197777 | B1 | 7/2015 |
| JP | 2001302139 | A | 10/2001 |
| WO | 0164572 | A1 | 9/2001 |
| WO | 2017051066 | A1 | 3/2017 |
| WO | 2018002243 | A1 | 1/2018 |

* cited by examiner

COMPENSATION LINE STORING APPARATUS, JUMP LIFT AND THE USAGE METHOD THEREOF

FOREIGN PRIORITY

This application claims priority to Chinese Patent Application No. 201810473845.0, filed May 17, 2018, and all the benefits accruing therefrom under 35 U.S.C. § 119, the contents of which in its entirety are herein incorporated by reference.

TECHNICAL FIELD

The present invention relates to the field of lift structures, and more particularly to a compensating wire bundle storage device for a jump lift, a jump lift comprising the compensating wire bundle storage device, and a usage method of the jump lift.

BACKGROUND ART

It is well known that jump lifts or jump-type lifts are often used in construction of buildings to lift or descend personnel and construction materials. A typical jump lift is designed such that it can be used in the construction of a super high-rise building with a height of up to several hundred meters and has a movable machine room. As the construction height of buildings constantly increases, the height of the machine room can also be constantly increased, so that the lifting height of the car is constantly increased to reach higher and higher floors. In use, the lift needs a steel cable to suspend the car and the counterweight (or balance weight) and uses a compensating device to balance them.

An existing typical compensating device comprises a compensating chain with one end attached to the bottom of the car and the other end attached to the bottom of the counterweight. Constrained by the physical properties of the compensating chain itself, the suspended weight limit of the compensating chain, and the Safety Regulations for Construction and Installation of Elevators (GB7588), the maximum lifting height that a jump lift using the existing compensating chain can provide is 300 m, and the maximum operation speed is 3 m/s.

However, as the height of buildings constantly increases, super high-rise buildings over 300 meters have been widely seen. The existing jump lifts can no longer satisfy the construction demands of super high-rise buildings. Accordingly, it is desirable to provide an improved compensating wire bundle storage device, a jump lift, and a usage method thereof to provide a greater lifting height and improve the efficiency.

SUMMARY OF THE INVENTION

It is an objective of the present invention to provide a compensating wire bundle storage device for a jump lift, which is capable of selectively storing or releasing a compensating rope and/or a compensating chain. Another objective of the present invention is to provide a jump lift comprising the compensating wire bundle storage device mentioned above. Another objective of the present invention is to provide a usage method of the jump lift mentioned above.

The objectives of the present invention are achieved through the following technical solutions: a compensating wire bundle storage device for a jump lift, comprising: one or more wire drums which are configured such that a compensating wire bundle is wound thereon and are fixed relative to the car of the jump lift; and a compensating wire bundle clamping device configured to releasably clamp the compensating wire bundle, wherein the compensating wire bundle clamping device is fixed under the car.

Optionally, the wire drums are fixed under the car, above the car or on a side of the car.

Optionally, the compensating wire bundle storage device comprises multiple wire drums, the wire drums are disposed in groups of two by means of stands, and one of the two wire drums is disposed above the other wire drum.

Optionally, the one or more wire drums are disposed such that the axis of rotation thereof is approximately horizontal, vertical or at an angle to the horizontal plane.

Optionally, the compensating wire bundle storage device further comprises a rope head fixing apparatus (FF0C) for fixing one end of the compensating wire bundle in position relative to the car.

Optionally, the compensating wire bundle is a compensating rope or a compensating chain.

Optionally, the compensating wire bundle storage device further comprises a supporting part suspended under the car by means of multiple posts, wherein the one or more wire drums and the compensating wire bundle clamping device are fixed to the supporting part.

Optionally, the compensating wire bundle clamping device is arranged in the middle of the supporting part, and the one or more wire drums are arranged around the compensating wire bundle clamping device.

Optionally, multiple rods are further provided between the multiple posts to enhance the structural strength.

Optionally, the multiple rods, the supporting part and the multiple posts are fixed together by welding, riveting or threaded connection.

Optionally, the multiple posts are detachably attached to the car.

Optionally, the multiple posts are detachably attached to the car by bolts or screws.

A jump lift, comprising: a car the top of which is connected to the top of a counterweight by a steel cable; a traction sheave supporting the steel cable; the compensating wire bundle storage device mentioned above, selectively mounted to the car; and a compensating wire bundle which is releasably fixed and stored by the compensating wire bundle storage device and has one end attached to the bottom of the counterweight and the other end attached to the car.

Optionally, the jump lift further comprises a tensioning wheel, an anti-bounce device, a braking device or a locking device.

A usage method of the jump lift mentioned above, comprising the steps of: 1) if the maximum lifting height is less than a first height, not attaching the compensating wire bundle storage device according to the present invention to the car; and 2) if the maximum lifting height is greater than or equal to the first height, when the lifting height of the jump lift becomes greater than or equal to the first height, mounting the compensating wire bundle storage device to the car and providing the compensating wire bundle to connect the car and the counterweight, wherein the compensating wire bundle is a compensating rope or a compensating chain.

Optionally, the first height is 30 meters.

Optionally, when the lifting height becomes greater than or equal to a second height, the compensating wire bundle is a compensating rope.

Optionally, the second height is 300 meters.

The compensating wire bundle storage device, the lift and the usage method thereof according to the present invention have the advantages of a simple structure, being easy to manufacture, being convenient to install, etc., and can provide a greater lifting height for lifts, thereby improving the operation efficiency.

BRIEF DESCRIPTION OF THE ACCOMPANYING DRAWINGS

The present invention will be further described in detail below with reference to the accompanying drawings and preferred embodiments, but those skilled in the art will understand that these drawings are drawn only for purpose of explaining the preferred embodiments and thus should not be taken as limitations of the scope of invention. In addition, unless specifically specified, the drawings are only intended to be illustrative of the constitution or construction of the described objectives and may include an exaggerated display, and the drawings are not necessarily drawn to scale.

DETAILED DESCRIPTION

Figure 1:
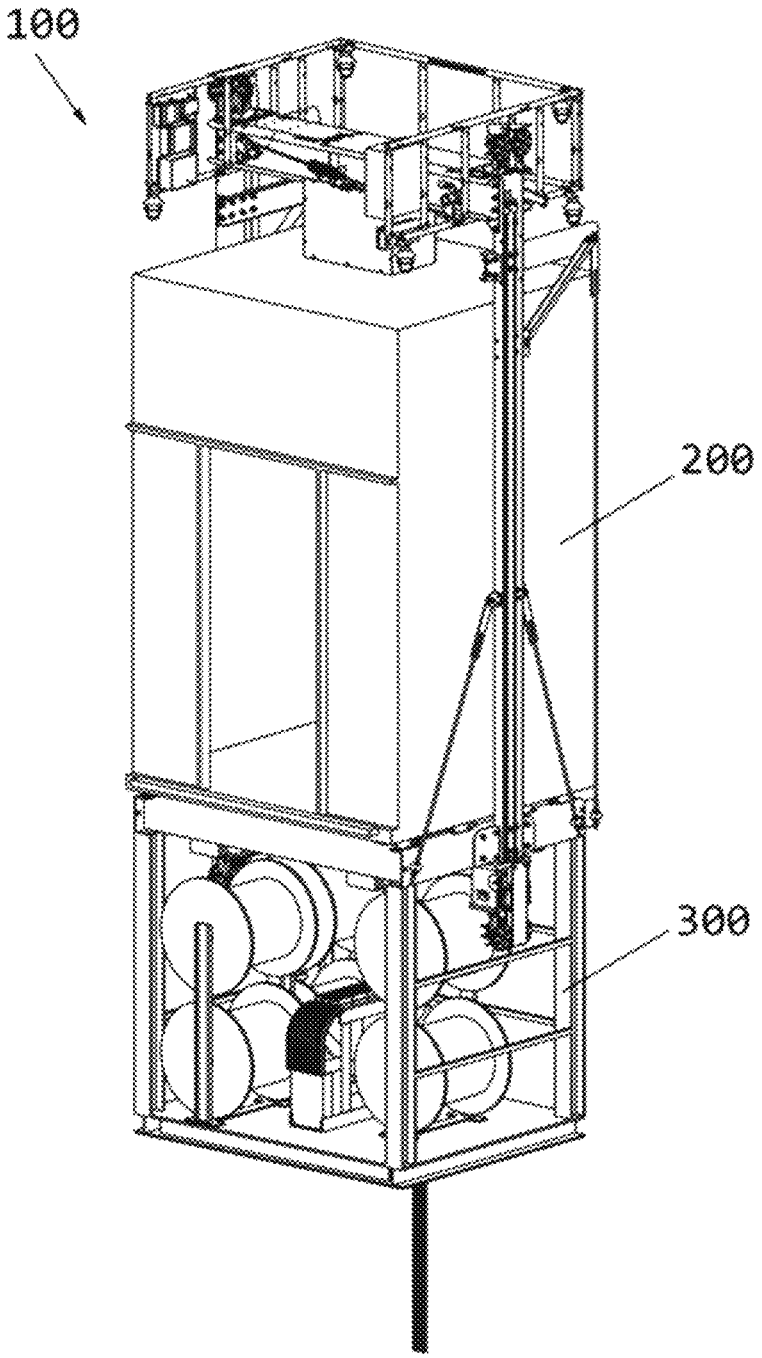
FIG. 1 is a stereoscopic view of an embodiment of a lift according to the present invention.

Hereinafter, preferred embodiments of the present invention will be described in detail with reference to the accompanying drawings. Those skilled in the art will appreciate that the descriptions are only illustrative and exemplary, and should not be construed as defining the scope of protection of the present invention.

First of all, it should be noted that orientation phases such as "top", "bottom", "upward" and "downward" are defined relative to the directions in the various accompanying drawings, are relative concepts, and thus may accordingly be varied according to their different locations and different usage stages. Therefore, these or other orientation phases should not be construed as limiting phases.

In addition, it should also be pointed out that for any single technical feature described or implied in the embodiments herein, or any single technical feature shown or implied in the accompanying drawings, these technical features (or equivalents thereof) can still be combined further, so as to arrive at other embodiments of the present invention not directly mentioned herein.

It should be noted that in different accompanying drawings, same reference numerals indicate the same or substantially the same components.

The present invention provides a compensating wire bundle storage device for a jump lift, comprising one or more wire drums which are configured such that a compensating wire bundle is wound thereon and are fixed relative to the car of the jump lift; and a compensating wire bundle clamping device configured to releasably clamp and fix the compensating wire bundle, wherein the compensating wire bundle clamping device is fixed under the car of the lift.

Optionally, the one or more wire drums can be fixed under, above, or on a slide face of the car.

FIG. 1 is a stereoscopic view of an embodiment of a lift according to the present invention. The lift 100 comprises a car 200 and a compensating wire bundle storage device 300, wherein the compensating wire bundle storage device 300 is used for releasably storing and/or fixing a compensating wire bundle. Other components of the lift 100 and their mounting and connection manners are readily available to those skilled in the art, including, but not limited to, a counterweight, a traction device, etc.

In one embodiment of the present invention, the lift 100 is a jump lift, and comprises: a car 200 the top of which is connected to the top of a counterweight by a steel cable; a traction sheave supporting the steel cable; a compensating wire bundle storage device 300 selectively mounted to the car 200; and a compensating wire bundle which is releasably fixed and stored by the compensating wire bundle storage device 300 and has one end attached to the bottom of the counterweight and the other end attached to the car 200.

In one embodiment of the present invention, the lift 100 is a jump lift arranged in a lift shaft of a building under construction. As the height of the building constantly increases, the traction device or machine room of the lift 100 can be raised accordingly so that the car 200 can reach a higher floor.

Figure 2:
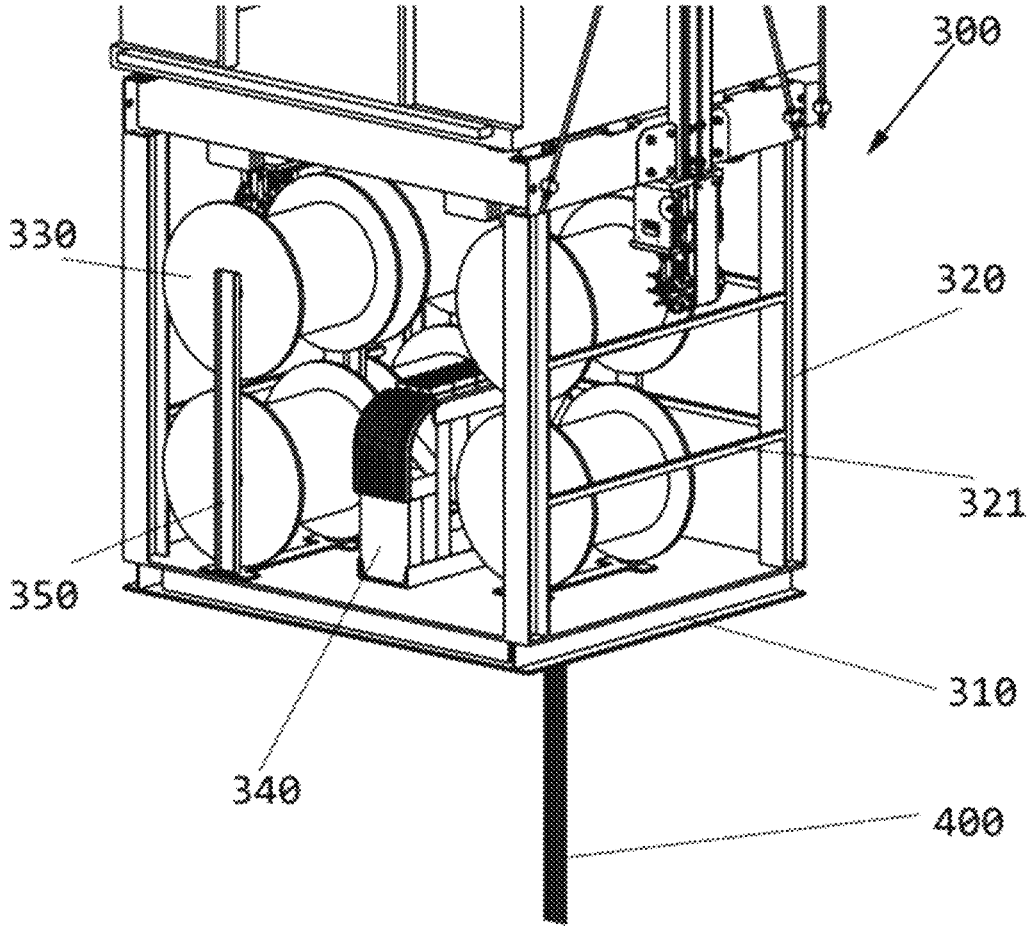
FIG. 2 is a partial enlarged view of the embodiment shown in FIG. 1.

FIG. 2 is a partial enlarged view of the embodiment shown in FIG. 1. The compensating wire bundle storage device 300 comprises a supporting part 310 suspended under the car 200 by means of multiple posts 320; and multiple wire drums 330 and a compensating wire bundle clamping device 340 which are fixed to the supporting part 310.

Optionally, the multiple wire drums 330 are disposed such that an axis of rotation thereof is approximately horizontal. However, depending on actual needs, the wire drums 330 can also be in other orientations, for example having the axis of rotation be substantially vertical or at an angle to the horizontal plane.

In an illustrated embodiment, the wire drums 330 are disposed in groups of two by means of stands 350, and one of the two wire drums is disposed above the other wire drum. In another embodiment, the wire drums can be disposed individually.

Optionally, the stands 350 are fixed to the supporting part 310 and are fixed relative to the car 200.

In the illustrated embodiment, the compensating wire bundle storage device 300 includes six wire drums 330, and the wire drums are disposed in pairs by three stands 310. Depending on the actual needs, other numbers of wire drums can also be provided, or wire drums of different sizes can be used.

In the illustrated embodiment, the compensating wire bundle clamping device 340 is arranged in the middle of the supporting part 310 and is surrounded by the wire drums 330. However, depending on the actual needs, the compensating wire bundle clamping device 340 may also be disposed on an edge of the supporting part 310.

Optionally, the lift 100 further comprises a tensioning wheel, an anti-bounce device, a braking device or a locking device, or the like.

Optionally, the compensating wire bundle storage device further comprises a rope head fixing apparatus for fixing one end of the compensating wire bundle in position relative to the car 200.

Optionally, multiple rods 321 are further provided between the posts 320 to enhance the structural strength of the compensating wire bundle storage device 300.

Optionally, the posts 320, the rods 321 and the supporting part 310 are connected integrally by welding, riveting or threaded connection.

Optionally, the multiple posts 320 are detachably attached to the car 200. For example, the posts 320 can be detachably attached to the car 200 by bolts or screws. In another embodiment of the present invention, the multiple posts 320 of the compensating wire bundle storage device 300 are directly welded or fixed to the car 200.

Optionally, the compensating wire bundle is a compensating rope or a compensating chain.

In the illustrated embodiment, the supporting part and the posts are configured to be fixed under the car. However, depending on the actual needs, the supporting part and the posts may also be arranged at other locations, such as above the car or on a side of the car where no lift door is provided. In another embodiment, the wire drums and the compensating wire bundle clamping device can be mounted at different locations of the car respectively and be provided with no supporting part or post.

For the sake of clarity, in the illustrated embodiment, the wound compensating wire bundle is not shown on the wire drums 300. However, it will be readily understood by those skilled in the art that the compensating wire bundle can be sequentially wound on each of the wire drums 300 and selectively released and clamped by the compensating wire bundle clamping device 340. A part of the compensating wire bundle 400 is shown in FIGS. 1 and 2, which is clamped by the compensating wire bundle clamping device 340 and extends in a vertical direction; and it will be easily understood that the other end of the compensating wire bundle 400 will be attached to the counterweight not shown.

The present invention also relates to a usage method of the jump lift mentioned above. The method comprises the following steps: 1) if the maximum lifting height is less than a first height, not attaching the compensating wire bundle storage device according to the present invention to the car; and 2) if the maximum lifting height is greater than or equal to the first height, when the lifting height of the jump lift becomes greater than or equal to the first height, mounting the compensating wire bundle storage device according to the present invention to the car and providing the compensating wire bundle to connect the car and the counterweight, wherein the compensating wire bundle is a compensating rope or a compensating chain.

In one embodiment of the present invention, if the maximum lifting height is greater than or equal to a second height, then the compensating wire bundle is a compensating rope.

Optionally, the length of the compensating wire bundle is approximately equal to the maximum lifting height. It is easy to understand that the height of the finally completed building has been determined during the design and construction of the building, so it is easy to determine the maximum lifting height of the jump lift.

Optionally, the first height is 30 meters. Those skilled in the art will appreciate that when the lifting height is low, the operation of the lift can be guaranteed without the use of a compensating wire bundle. Therefore, the compensating wire bundle storage device according to the present invention can be not mounted to the car, thereby reducing the weight of the car and improving the operation efficiency.

Optionally, the second height is 300 meters. However, the second height will vary according to the size of the compensating wire bundle used, and those skilled in the art can determine the specific value of the second height based on parameters of the compensating rope actually used. Those skilled in the art will recognize that when the lifting height exceeds the second height, the compensating chain is susceptible to wobble, resulting in instability of the lift, and is not suitable for use when the lifting height exceeds the second height. Therefore, when the lifting height exceeds the second height, a compensating rope is used as the compensating wire bundle, which is beneficial to improving the stability of the lift.

For example, suppose that the length of current compensating wire bundle is 100 meters, the number of floors built in the building increases, and it is expected that the car can reach a higher floor, the compensating wire bundle clamping device 340 can be loosened with protection measures to release a longer compensating wire bundle such that the length of the compensating wire bundle reaches for example 110 meters, thereby allowing the car to reach a higher height.

According to one embodiment of the present invention, the mass of a compensating wire bundle storage device is approximately 500 kilograms, and length of the compensating wire bundle wound on the wire drums is 300 meters and has a weight of 1150 kilograms. Therefore, the additional weight needing to be borne by the car side is 1650 kilograms, which does not exceed the load range that the lift system is designed to be capable of bearing.

According to one embodiment of the present invention, a lift employing a compensating wire bundle storage device according to the present invention can be lifted to a height of about 500 meters and has a maximum speed of more than 3 m/s, and various parameters of the lift still conform to the mandatory requirements of the national and the industrial standards.

By means of the compensating wire bundle storage device of the present invention, the length of the compensating wire bundle can be used as needed during constantly rising the lifting height of a jump lift, so that the lift can reach a higher lifting height and have a higher running speed. Therefore, the maintenance cost of the lift is lowered, and the running efficiency thereof is improved.

The present specification discloses the present invention with reference to the accompanying drawings and also enables those skilled in the art to embody the present invention, including fabricating and using any apparatus or system, choosing a suitable material and using any combined method. The scope of the present invention is defined by the claimed technical solutions, and comprises other instances came up with by a person skilled in the art. As long as such other instances include structural elements that are not different from the literal language of the claimed technical solutions, or such other instances contain equivalent structural elements that are not substantially different from the literal language of the claimed technical solutions, such other instances should be considered within the scope of protection as determined by the technical solutions claimed by the present invention.

What is claimed is:

1. A compensating wire bundle storage device for a jump lift, the compensating wire bundle storage device comprising:

one or more wire drums which are configured such that a compensating wire bundle is wound thereon and are fixed relative to a car of the jump lift; and a compensating wire bundle clamping device configured to releasably clamp the compensating wire bundle, wherein the compensating wire bundle clamping device is fixed under the car;

wherein the one or more wire drums comprises multiple wire drums, the wire drums are disposed in groups of two by means of stands, and one of the two wire drums is disposed above the other wire drum.

2. The compensating wire bundle storage device according to claim 1, wherein the wire drums are fixed under the car, above the car or on a side of the car.

3. The compensating wire bundle storage device according to claim 1, wherein the one or more wire drums are disposed such that the axis of rotation thereof is approximately horizontal, vertical or at an angle to the horizontal plane.

4. The compensating wire bundle storage device according to claim 1, further comprising a rope head fixing apparatus for fixing one end of the compensating wire bundle in position relative to the car.

5. The compensating wire bundle storage device according to claim 1, wherein the compensating wire bundle is a compensating rope or a compensating chain.

6. The compensating wire bundle storage device according to claim 1, further comprising a supporting part suspended under the car by means of multiple posts, wherein the one or more wire drums and the compensating wire bundle clamping device are fixed to the supporting part.

7. The compensating wire bundle storage device according to claim 6, wherein the compensating wire bundle clamping device is arranged in the middle of the supporting part, and the one or more wire drums are arranged around the compensating wire bundle clamping device.

8. The compensating wire bundle storage device according to claim 6, wherein multiple rods are further provided between the multiple posts to enhance the structural strength.

9. The compensating wire bundle storage device according to claim 8, wherein the multiple rods, the supporting part and the multiple posts are fixed together by welding, riveting or threaded connection.

10. The compensating wire bundle storage device according to claim 6, wherein the multiple posts are detachably attached to the car.

11. The compensating wire bundle storage device according to claim 10, wherein the multiple posts are detachably attached to the car by bolts or screws.

12. A jump lift comprising:

a car, the top of which is connected to the top of a counterweight by a steel cable;

a traction sheave supporting the steel cable;

a compensating wire bundle storage device including:

one or more wire drums which are configured such that a compensating wire bundle is wound thereon and are fixed relative to the car; and a compensating wire bundle clamping device configured to releasably clamp the compensating wire bundle, wherein the compensating wire bundle clamping device is fixed under the car;

wherein the one or more wire drums comprises multiple wire drums, the wire drums are disposed in groups of two by means of stands, and one of the two wire drums is disposed above the other wire drum;

and a compensating wire bundle which is releasably fixed and stored by the compensating wire bundle storage device and has one end attached to the bottom of the counterweight and the other end attached to the car.

13. The jump lift according to claim 12, wherein the compensating wire bundle storage device includes a tensioning wheel, an anti-bounce device, a braking device or a locking device.

14. A usage method of the jump lift according to claim 12, the method comprising:

if the maximum lifting height is less than a first height, not attaching the compensating wire bundle storage device according to the present invention to the car; and if the maximum lifting height is greater than or equal to the first height, when the lifting height of the jump lift becomes greater than or equal to the first height, mounting the compensating wire bundle storage device to the car and providing the compensating wire bundle to connect the car and the counterweight, wherein the compensating wire bundle is a compensating rope or a compensating chain.

15. The method according to claim 14, wherein the first height is 30 meters.

16. The method according to claim 14, wherein when the lifting height becomes greater than or equal to a second height, the compensating wire bundle is a compensating rope.

17. The method according to claim 16, wherein the second height is 300 meters.

* * * * *